US008148049B2

(12) United States Patent
Murayama et al.

(10) Patent No.: US 8,148,049 B2
(45) Date of Patent: Apr. 3, 2012

(54) INK JET RECORDING HEAD AND MANUFACTURING METHOD OF THE SAME

(75) Inventors: Hiroyuki Murayama, Kawasaki (JP); Junichi Kobayashi, Ayase (JP); Yoshinori Tagawa, Yokohama (JP); Kenji Fujii, Kawasaki (JP); Hideo Tamura, Kawasaki (JP); Taichi Yonemoto, Isehara (JP); Keiji Watanabe, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 714 days.

(21) Appl. No.: 11/680,821

(22) Filed: Mar. 1, 2007

(65) Prior Publication Data

US 2007/0207414 A1 Sep. 6, 2007

(30) Foreign Application Priority Data

Mar. 6, 2006 (JP) ..... 2006-059536

(51) Int. Cl.
*G03C 5/00* (2006.01)

(52) U.S. Cl. ..... 430/311

(58) Field of Classification Search ..... None
See application file for complete search history.

(56) References Cited

U.S. PATENT DOCUMENTS

| | | | | |
|---|---|---|---|---|
| 5,478,606 | A | 12/1995 | Ohkuma et al. | |
| 5,774,150 | A | 6/1998 | Kobayashi et al. | |
| 6,033,581 | A | 3/2000 | Kobayashi | |
| 6,447,102 | B1 | 9/2002 | Chen et al. | |
| 6,520,626 | B1 | 2/2003 | Murakami | |
| 6,591,500 | B1 | 7/2003 | Suzuki et al. | |
| 7,036,909 | B2 | 5/2006 | Kubota et al. | |
| 7,523,553 | B2 * | 4/2009 | Ohsumi et al. | 29/890.1 |
| 2003/0016270 | A1 * | 1/2003 | Kubota et al. | 347/47 |
| 2004/0035823 | A1 * | 2/2004 | Min et al. | 216/27 |
| 2004/0036744 | A1 * | 2/2004 | Cho et al. | 347/65 |
| 2004/0191704 | A1 * | 9/2004 | Nishi et al. | 430/324 |
| 2006/0134555 | A1 * | 6/2006 | Park et al. | 430/311 |

FOREIGN PATENT DOCUMENTS

| | | | |
|---|---|---|---|
| JP | 58204532 | * | 11/1983 |
| JP | 11-314371 A | | 11/1999 |
| JP | 2000-280479 A | | 10/2000 |
| JP | 2003-6943 | * | 1/2003 |
| WO | WO-2006-001532 | * | 1/2006 |

* cited by examiner

*Primary Examiner* — Cynthia Kelly
*Assistant Examiner* — Anna Verderame
(74) *Attorney, Agent, or Firm* — Fitzpatrick, Cella, Harper & Scinto

(57) ABSTRACT

A manufacturing method of an ink jet recording head includes steps of forming a liquid flow path mold material of a soluble resin on a substrate on which an energy generating element is formed, the energy generating element being configured to generate energy for use in discharging ink; forming a coating resin layer of a negative photosensitive resin on the substrate on which the mold material is formed; exposing and developing the coating resin layer to form an ink discharge port in the coating resin layer; and dissolving and removing the mold material to form a liquid flow path. During the exposing of the coating resin layer, a total amount of exposure energy per unit area applied to an exposure region other than a region of the coating resin layer positioned above the mold material is greater than that of exposure energy per unit area applied to the region of the coating resin layer positioned above the mold material.

8 Claims, 4 Drawing Sheets

INK JET RECORDING HEAD AND MANUFACTURING METHOD OF THE SAME

BACKGROUND OF THE INVENTION

1. Field of the Invention

The present invention relates to an ink jet recording head for use in an ink jet recording system and a manufacturing method of the head.

2. Description of the Related Art

An ink jet recording head applied to an ink jet recording system includes a generally fine ink discharge port, a liquid flow path and an ink discharge energy generating element arranged in a part of the liquid flow path.

Heretofore, as a method of manufacturing such an ink jet recording head, U.S. Pat. No. 5,478,606 discusses a method having the following steps: (1) a step of forming a pattern which constitutes an ink flow path mold material of a soluble resin on a substrate on which ink discharge pressure generating elements are formed; (2) a step of dissolving a coating resin including a photosensitive resin, and coating a layer of the soluble resin with the solvent to thereby form a coating resin layer which constitutes an ink flow path wall on the soluble resin layer; (3) a step of forming the ink discharge ports in the coating resin layer above the ink discharge pressure generating elements; and (4) a step of eluting the soluble resin layer.

Usually in the above manufacturing method, the coating resin layer is formed of a photosensitive resin, the coating resin layer is exposed via a mask having an ink discharge port forming pattern, and then developed to thereby form the ink discharge ports. When the coating resin layer is formed of, for example, a negative photosensitive resin, this exposure is once performed on the whole surface of a region other than regions constituting the ink discharge ports. Moreover, at this time, exposure energy is set so that the coating resin layer develops sufficient adhesion to the substrate.

Moreover, as a liquid discharge head capable of coping with a high liquid droplet discharge speed, a liquid discharge head is also discussed in which a height of an ink flow path pattern (the mold material) manufactured in a manufacturing stage is changed so as to form the liquid flow paths having different heights (U.S. Pat. No. 7,036,909).

Here, in recent years, with development of a recording technology, highly precise recording has been demanded in an ink jet recording technology. As a method which meets such a demand, investigations of a method for minimizing ink droplets discharged from the ink jet recording head are advanced. The technique has a tendency to reduce a thickness (a thickness of an orifice plate) of the coating resin layer to be formed on the mold material and a tendency to reduce a diameter of each ink discharge port.

However, if the thickness of the orifice plate decreases, the coating resin layer above the ink flow path pattern might be excessively irradiated with the heretofore applied exposure energy, and sag and shape change of pattern edges might be generated. Therefore, it is difficult to highly precisely form micro ink discharge ports and polygonal ink discharge ports. Since light is transmitted through the coating resin layer, there is fear of an influence of reflection of the light from the substrate.

Furthermore, owing to the excessive irradiation, a part of the resin constituting the mold material is sometimes sensitized and depolymerized with the exposure energy transmitted through the coating resin layer. This depolymerized resin is easily damaged by a development liquid during the next developing step, and cracks might be generated. The generated cracks grow into voids in the mold material and an interface between the mold material and the coating resin layer owing to thermal history during the subsequent steps, finally destroy a protective material during anisotropic etching of the substrate and deteriorate a protecting function. This causes unstable ink discharge and deteriorates a printing quality owing to disturbance of an ink discharge direction. It is confirmed that as a diameter of each ink discharge port decreases, this phenomenon easily occurs.

Even in the liquid discharge head manufactured by changing the height of the mold material, there is a region where the orifice plate has a small thickness. Therefore, a problem similar to the above problem easily occurs.

If the exposure energy is reduced in order to inhibit the above sag and shape change of the pattern edges and inhibit the generation of the cracks in the mold material, it is difficult to secure sufficient adhesion between the coating resin layer and the substrate. That is, it has been difficult to manufacture an ink jet recording head capable of performing high-quality printing while securing the sufficient adhesion between the coating resin layer and the substrate, depending on the thicknesses of the orifice plate and the coating resin layer.

SUMMARY OF THE INVENTION

The present invention has been developed in view of the above problems. An object of the present invention is to provide an ink jet recording head and a manufacturing method of the head in which high-quality printing can be performed while securing sufficient adhesion between a coating resin layer and an adhesion enhancing layer and between the coating resin layer and a substrate, irrespective of thicknesses of an orifice plate and the coating resin layer.

One aspect of the present invention is described below. A manufacturing method of an ink jet recording head comprises: forming a liquid flow path mold material of a soluble resin on a substrate on which an energy generating element is formed, the energy generating element being configured to generate energy for use in discharging ink; forming a coating resin layer of a negative photosensitive resin on the substrate on which the mold material is formed; exposing and developing the coating resin layer to form an ink discharge port in the coating resin layer; and dissolving and removing the mold material to form a liquid flow path, wherein during the exposing of the coating resin layer, a total amount of exposure energy per unit area, applied to an exposure region other than a region of the coating resin layer positioned above the mold material, is larger than that of exposure energy per unit area, applied to the region of the coating resin layer positioned above the mold material.

A method of exposing the coating resin layer can comprise: exposing the exposure region other than the region of the coating resin layer positioned above the mold material; and then exposing the exposure region of the coating resin layer positioned above the mold material. The method of the present invention is suitable for the ink discharge ports having a polygonal shape.

Moreover, the present invention is directed to an ink jet recording head manufactured by the above manufacturing method of the ink jet recording head.

The present invention can be directed to an ink jet recording head and a manufacturing method of the ink jet recording head in which high-quality printing can be performed while securing sufficient adhesion between the coating resin layer and the substrate irrespective of thicknesses of an orifice plate and the coating resin layer.

More specifically, even if the orifice plate has a thin region, the sufficient adhesion between the substrate and the coating resin layer can be compatible with high fineness in patterning of the coating resin layer. Furthermore, cracks can be inhibited from being generated in the mold material of the liquid flow path, and a printing defect can be suppressed. In consequence, a manufacturing method of an ink jet recording head can be provided in which the ink is stably discharged and which has a high yield and which is capable of performing the high-quality printing.

Further features of the present invention will become apparent from the following description of exemplary embodiments (with reference to the attached drawings).

DESCRIPTION OF THE EMBODIMENTS

An embodiment of the present invention is described below with reference to the drawings.

Examples 1 and 2

FIGS. 1A to 1I are schematic sectional views illustrating one embodiment of a manufacturing method of an ink jet recording head according to the present invention. It is to be noted that FIGS. 1A to 1I correspond to schematic sectional views cut along the A-A line of FIG. 2 which is a partially cut perspective view schematically illustrating a part of the ink jet recording head.

Figure 1A:
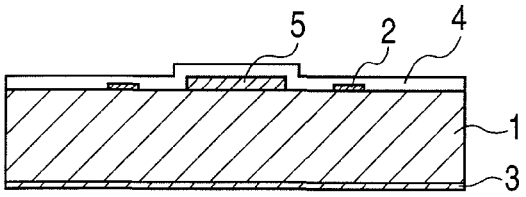
FIGS. 1A, 1B, 1C, 1D, 1E, 1F, 1G, 1H and 1I are schematic sectional views illustrating examples of manufacturing steps of an ink jet recording head according to the present invention.
Figure 2:
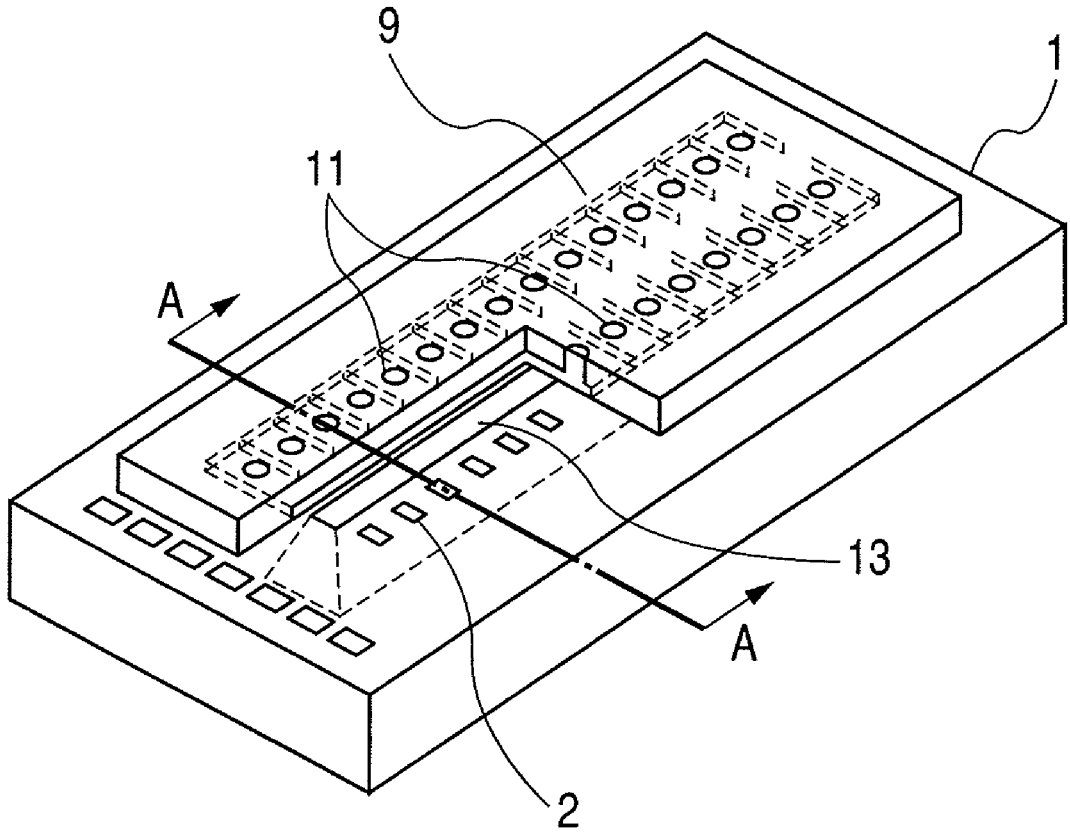
FIG. 2 is a partially cut perspective view schematically illustrating a part of the ink jet recording head.

First, as shown in FIG. 1A, an energy generating element 2 such as a heating resistive element is arranged on the surface of a substrate 1. As the substrate 1, for example, a silicon substrate of a crystal orientation <100> can be used. As shown in FIG. 1A, a protective layer 4 and a sacrifice layer 5 are formed on the surface of the substrate 1 as desired, and a $SiO_2$ film 3 is formed on the backside of the substrate 1 as desired.

Figure 1B:
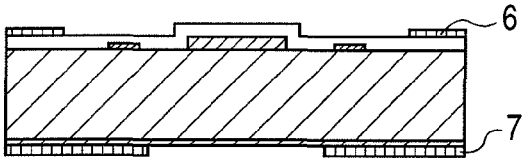

Furthermore, as shown in FIG. 1B, an adhesion enhancing layer 6 can be formed on the surface of the substrate 1, and a polyether amide resin layer 7 can be formed on the backside of the substrate. A method of forming the layers is described below. First, the surface and the backside of the substrate 1 are coated with a polyether amide resin, and baked to harden. Moreover, the surface of the substrate 1 is coated with a resist by spin coating, exposed and developed in order to pattern the polyether amide resin constituting the adhesion enhancing layer 6 on the surface 1. Next, after the patterning is performed by dry etching by use of this resist as a mask to form the adhesion enhancing layer 6, the resist is peeled off. By a similar step, after the patterning of the polyether amide resin on the backside of the substrate 1 is performed by the dry etching to form the polyether amide resin layer 7, the positive resist is peeled off.

Figure 1C:
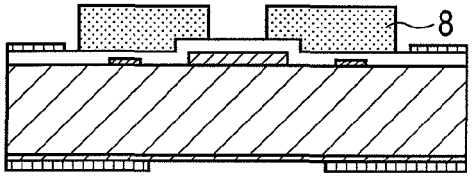

Next, as shown in FIG. 1C, a mold material 8 constituting a mold of liquid flow path is formed of a soluble resin on the surface of the substrate 1. For example, the substrate 1 is coated with a positive resist as the soluble resin, and patterned into a pattern shape constituting the liquid flow path. In consequence, the mold material 8 can be formed. A thickness of the mold material 8 is usually set in a range of 5 μm to 30 μm. The present invention is highly effective especially in a case where the mold material 8 having a thickness of 17 μm to 30 μm is formed. Here, the mold materials 8 having thicknesses of 14 μm (Example 1) and 20 μm (Example 2) were formed.

As the positive resist for use as the soluble resin forming the mold material 8, ODUR manufactured by Tokyo Ohka Kogyo Co., Ltd. was used in the present example.

Figure 1D:
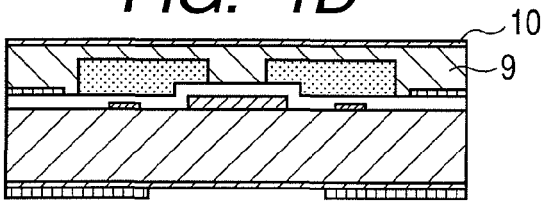

Next, as shown in FIG. 1D, a coating resin layer 9 is formed of a negative photosensitive resin on the substrate 1 on which the mold material 8 is formed by a method such as spin coating. Furthermore, a layer constituting a water repellent layer 10 is laminated on the coating resin layer 9 as desired. A thickness of the coating resin layer 9 from the surface of the substrate 1 is usually set in a range of 10 μm to 60 μm. The present invention is remarkably effective especially in a case where a thickness of an orifice plate (the thickness of the coating resin layer 9 excluding the thickness of the mold material 8) is smaller than a thickness 1/2.5 times the thickness from the surface of the substrate 1. Here, the coating resin layer 9 was formed with a thickness of 25 μm from the surface of the substrate 1. That is, the thicknesses of the orifice plate were 11 μm (Example 1) and 5 μm (Example 2).

Examples of the negative photosensitive resin forming the coating resin layer 9 include a cationically polymerized epoxy resin.

Next, the coating resin layer 9 is exposed and developed to form a discharge port 11 in the coating resin layer 9. Here, during the exposure of the coating resin layer 9, a total amount of exposure energy per unit area, applied to an exposure region other than a region of the coating resin layer 9 positioned above the mold material 8, is set to be larger than that of exposure energy per unit area, applied to a region positioned above the mold material 8, of the coating resin layer 9. The total amount of exposure energy per unit area is calculated by dividing an irradiated exposure energy by an area of an irradiated portion with respect to the coating resin layer 9 which finally becomes a member forming a flow path. Therefore, an exposure energy irradiated to a portion of coating resin layer 9 which does not finally become the member forming the flow path, and the area of the portion are not included in the calculation.

Since the exposure region other than the region positioned above the mold material 8 is thick and the other exposure region (i.e., the exposure region positioned above the mold material 8) of the coating resin layer 9 is thin, the regions differ with the suitable exposure energy. Therefore, when the exposure energy is changed with the exposure region of the coating resin layer 9 as described above, the suitable exposure energy can be applied to the regions, respectively. During the exposure, the coating resin layer 9 may be irradiated with necessary quantities of ultraviolet light and deep UV light according to photosensitivity of the negative resist for use in forming the coating resin layer 9. Specifically, the exposure can be performed, for example, by the following method.

Figure 1E:
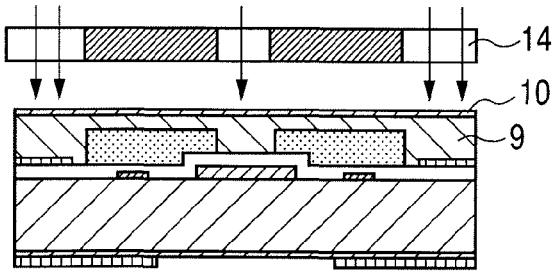

First, as shown in FIG. 1E, the only exposure region other than the region positioned above the mold material 8 is exposed via a mask 14. The coating resin layer 9 of this region is thicker than the region positioned above the mold material 8, and requires a large exposure amount in order to secure sufficient adhesion between the coating resin layer 9 and the substrate 1. Therefore, when this region is exposed to the necessary exposure energy, the sufficient adhesion between the coating resin layer 9 and the substrate 1 can be secured. As irradiative light, the ultraviolet light and the deep UV light can be used, and a wavelength of the light can be selected from a range of 290 nm to 400 nm. The necessary exposure energy can appropriately be set in consideration of photosensitivity of the negative photosensitive resin forming the coating resin layer 9, the thickness of the coating resin layer 9 and the wavelength of the irradiative light. Here, when the thickness of the orifice plate was 11 μm (Example 1), the region was irradiated so as to obtain exposure energy of 110 mJ/cm$^2$. When the thickness of the orifice plate was 5 μm (Example 2), the region was irradiated so as to obtain exposure energy of 150 mJ/cm$^2$.

Figure 1F:
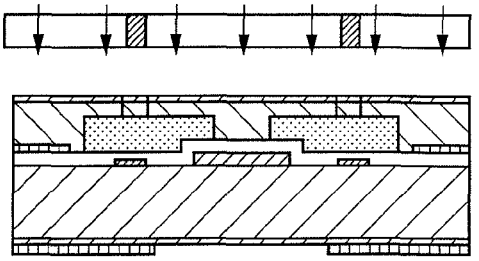

Next, as shown in FIG. 1F, the exposure region positioned above the mold material 8 is exposed via the mask 14. Here, the region positioned above the mold material 8 has a thickness smaller than that of the previously irradiated region, and requires only a small exposure amount. Therefore, this region is exposed with small exposure energy. At this time, as shown in FIG. 1F, the whole surface of the exposure region of the coating resin layer 9 may be irradiated with the light. As the irradiative light, the ultraviolet light and the deep UV light can be used in the same manner as in FIG. 1E. The necessary exposure energy can appropriately be set in consideration of the photosensitivity of the negative photosensitive resin forming the coating resin layer 9, the thickness of the orifice plate and the wavelength of the irradiative light. The energy is selected from a range of, for example, 40 to 110 mJ/cm$^2$. Here, when the thickness of the orifice plate was 11 μm (Example 1), the region was irradiated so as to obtain exposure energy of 90 mJ/cm$^2$. When the thickness of the orifice plate was 5 μm (Example 2), the region was irradiated so as to obtain exposure energy of 50 mJ/cm$^2$. That is, the region exposed in two steps of FIGS. 1E and 1F was exposed so as to obtain energy of 200 mJ/cm$^2$ in total. Needless to say, in FIG. 1F, the region to which the exposure energy is applied in the previous step may be covered with a mask, and the region does not have to be irradiated. However, in this case, the exposure to the exposure energy of 200 mJ/cm$^2$ in total described above needs to be performed in the step of FIG. 1E.

Figure 5:
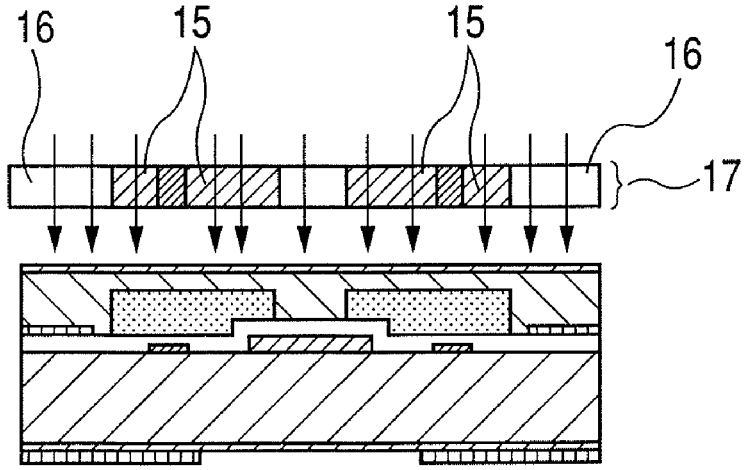
FIG. 5 is a schematic sectional view illustrating a modified example of manufacturing steps illustrated in FIGS. 1E and 1F.

In the present example, the exposure region other than the region positioned above the mold material 8 was first exposed, but the coating resin layer 9 of the exposure region positioned above the mold material 8 may first be exposed. Alternatively, after exposing the whole surface of the exposure region of the coating resin layer 9, a portion other than the region positioned above the mold material 8 may be exposed. As an example, the steps shown in FIGS. 1E and 1F may be replaced with a step shown in FIG. 5. That is, the above exposure can be performed once by use of a mask having a different exposure energy transmittance so as to obtain desired exposure energy in the exposure region other than the region positioned above the mold material 8 and the exposure region positioned above the mold material 8. In the example shown in FIG. 5, as one example, a mask 17 (light transmittance of each portion 15 is lower than that of each portion 16) is used.

According to the above technique, the total amount of the exposure energy applied to the coating resin layer 9 of the region positioned above the mold material 8 can selectively be reduced. Moreover, sag and shape change of an edge portion (a boundary between an exposed portion and an unexposed portion) of each discharge port 11 can be reduced. Therefore, patterning of a complicated finer shape can be performed. For example, not only a general circular ink discharge port but also a polygonal ink discharge port and a micro circular and a micro polygonal ink discharge port capable of discharging a micro liquid droplet can highly finely be formed.

Furthermore, as described above, if the coating resin layer 9 is excessively irradiated, a part of the mold material 8 is sensitized with the exposure energy transmitted through the coating resin layer 9, and depolymerized. This is a cause for generation of cracks in the mold material 8. If the cracks are generated, ink is finally unstably discharged, and a printing quality deteriorates owing to disturbance of an ink discharge direction. However, according to the present invention, this crack generation can be inhibited.

Figure 1G:
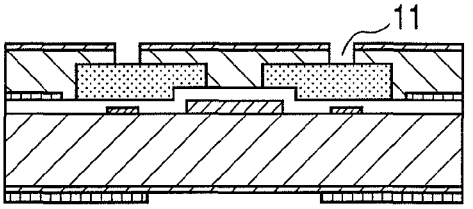

Subsequently, the coating resin layer 9 is developed to form the discharge port 11 as shown in FIG. 1G.

Figure 1H:
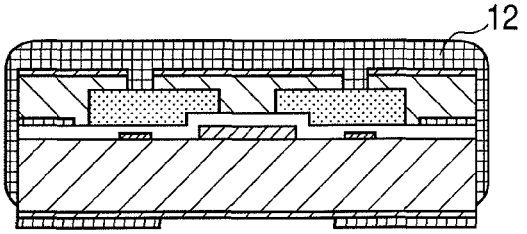

Next, as shown in FIG. 1H, a protective material 12 is formed by spin coating so as to cover the surface and side surfaces of the substrate 1 on which the mold material 8 and the coating resin layer 9 are formed. The $SiO_2$ film 3 on the backside of the substrate 1 is removed by wet etching so as to expose an Si surface which is an etching start surface during the wet etching of the substrate 1. Next, an ink supply opening 13 is disposed in the substrate 1. This ink supply opening 13 can be formed by chemically etching the substrate 1. For example, the substrate can be subjected to anisotropic etching by use of a strongly alkaline solution such as TMAH to form the ink supply opening. Moreover, the anisotropic etching from the backside of the substrate 1 reaches the sacrifice layer 5 to make an opening in the substrate. Furthermore, a part of the protective layer 4 is removed to form the ink supply opening 13.

Next, the polyether amide resin layer 7 and the protective material 12 are removed. Furthermore, the mold material 8 is eluted from the discharge port 11 and the ink supply opening 13 so as to form a liquid flow path and a bubbling chamber.

Moreover, the substrate 1 is cut and separated into chips with a dicing saw. Each chip is electrically bonded in order to drive the ink discharge energy generating element 2. Subsequently, the chip is connected to a chip tank member for supplying the ink. In consequence, the ink jet recording head is completed.

Comparative Examples 1 and 2

FIGS. 3A to 3H are schematically sectional views illustrating basic manufacturing steps of a conventional ink jet recording head. It is to be noted that FIGS. 3A to 3H correspond to schematic sectional views cut along the A-A line of FIG. 2 which is a partially cut perspective view schematically illustrating a part of the ink jet recording head.

First, as shown in FIG. 3A to 3D, steps are performed in the same manner as in the steps shown in FIGS. 1A to 1D. On a substrate 1 on which a plurality of ink discharge energy generating elements 2 are arranged, a mold material 8, a coating resin layer 9 and a water repellent layer 10 are formed. On the surface of the substrate 1, a protective layer 4, a sacrifice layer 5 and an adhesion enhancing layer 6 are formed as desired. A $SiO_2$ film 3 and a polyether amide resin layer 7 are formed on the backside of the substrate 1 as desired. Here, the mold materials 8 having thicknesses of 14 μm (Comparative Example 1) and 20 μm (Comparative Example 2) were formed using ODUR manufactured by Tokyo Ohka Kogyo Co., Ltd. as a positive resist. The coating resin layer 9 was formed with a thickness of 25 μm from the surface of the substrate 1 by use of a photopolymerized epoxy resin as a negative resist. That is, thicknesses of orifice plates were 11 μm (Comparative Example 1) and 5 μm (Comparative Example 2).

Figure 3A:
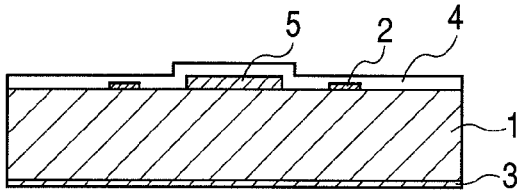
FIGS. 3A, 3B, 3C, 3D, 3E, 3F, 3G and 3H are schematically sectional views illustrating manufacturing steps of a conventional ink jet recording head.
Figure 3B:
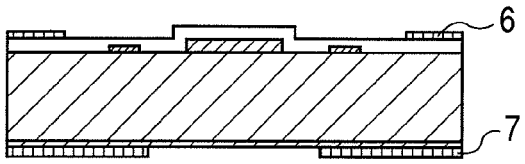
Figure 3C:
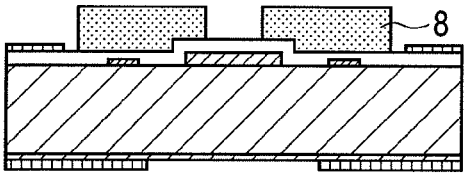
Figure 3D:
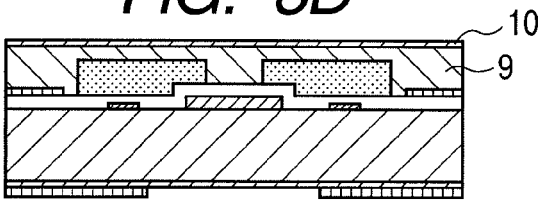
Figure 3E:
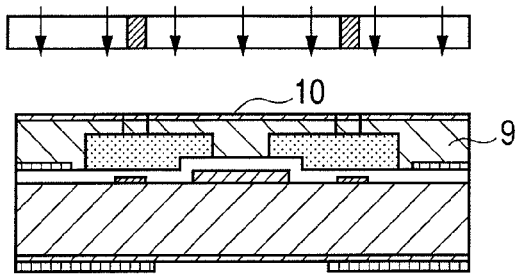

Next, the coating resin layer 9 is exposed and developed to form a discharge port 11 in the coating resin layer 9. Here, as shown in FIG. 3E, to expose the coating resin layer 9, the whole surface of a region other than regions forming the discharge port 11 is exposed. Here, in the comparative examples, when the thickness of the orifice plate was 11 μm (Comparative Example 1), the exposure was performed in consideration of wavelengths in the same manner as in Examples 1 and 2 so as to obtain exposure energy of 90 mJ/cm$^2$, 150 mJ/cm$^2$ and 200 mJ/cm$^2$. Moreover, when the thickness of the orifice plate was 5 μm (Comparative Example 2), the exposure was performed in consideration of the wavelengths in the same manner so as to obtain exposure energy of 50 mJ/cm$^2$, 150 mJ/cm$^2$ and 200 mJ/cm$^2$.

Figure 1I:
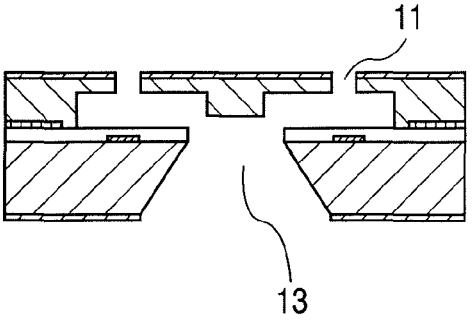
Figure 3F:
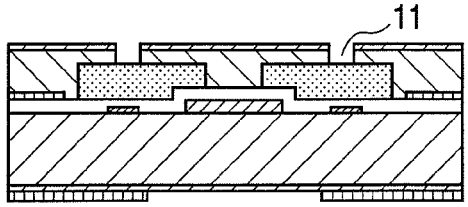
Figure 3G:
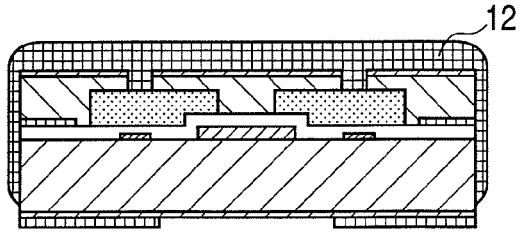
Figure 3H:
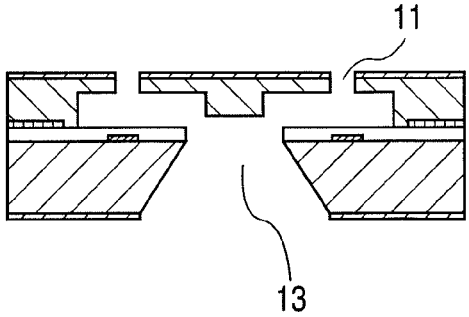

Subsequently, as shown in FIGS. 3F to 3H, steps are performed in the same manner as in the steps shown in FIGS. 1G to 1I, and the discharge port 11, an ink supply opening 13, a liquid flow path and a bubbling chamber are formed. Moreover, the substrate 1 is cut and separated into chips with a dicing saw. Each chip is electrically bonded in order to drive ink discharge energy generating elements 2. Subsequently, the chip is connected to a chip tank member for supplying ink. In consequence, the ink jet recording head is completed.

(Evaluation of Prepared Ink Jet Recording Heads)

Crack generation and adhesion were evaluated with respect to the ink jet recording heads prepared in Examples 1 and 2 and Comparative Examples 1 and 2 described above. Results are shown in Table 1. It is to be noted that to evaluate the crack generation, the coating resin layer 9 is exposed and developed, the discharge port 11 is formed in the coating resin layer 9 and then it is checked whether or not cracks are generated in the mold material 8. Moreover, when no cracks were generated, the head was evaluated as "o". When cracks were generated, the head was evaluated as "x". To evaluate the adhesion, it is checked whether or not the adhesion enhancing layer 6 and the coating resin layer 9 on the substrate 1 are brought into close contact with each other. Specifically, for example, the liquid flow path is filled with liquid such as the ink, and it can be judged whether or not the ink is interposed in an interface between the adhesion enhancing layer 6 and the coating resin layer 9 to evaluate the adhesion. Furthermore, when no ink was interposed in the interface between the adhesion enhancing layer 6 and the coating resin layer 9, the head was evaluated as "o". When ink was interposed, the head was evaluated as "x".

According to the present invention, it can be confirmed from results of Examples 1 and 2 that no crack is generated in the mold material and sufficient adhesion between the coating resin layer and the substrate can be secured irrespective of the thicknesses of the orifice plate and the coating resin layer. On the other hand, according to the conventional method, it can be confirmed from results of Comparative Examples 1 and 2 that, when the thickness of the orifice plate is reduced, it is difficult to inhibit the generation of the cracks in the mold material and to secure the sufficient adhesion between the coating resin layer and the substrate.

TABLE 1

| | Orifice plate thickness (μm) | Exposure energy (mJ/cm$^2$) Above mold material | Exposure energy (mJ/cm$^2$) Others | Crack generation | Adhesion |
|---|---|---|---|---|---|
| Example 1 | 11 | 90 | 200 | o | o |
| Example 2 | 5 | 50 | 200 | o | o |
| Comparative Example 1 | 11 | 90 | | o | x |
| | | 150 | | o | o |
| | | 200 | | x | o |
| Comparative Example 2 | 5 | 50 | | o | x |
| | | 150 | | x | o |
| | | 200 | | x | o |

Another Embodiment

Figure 4:
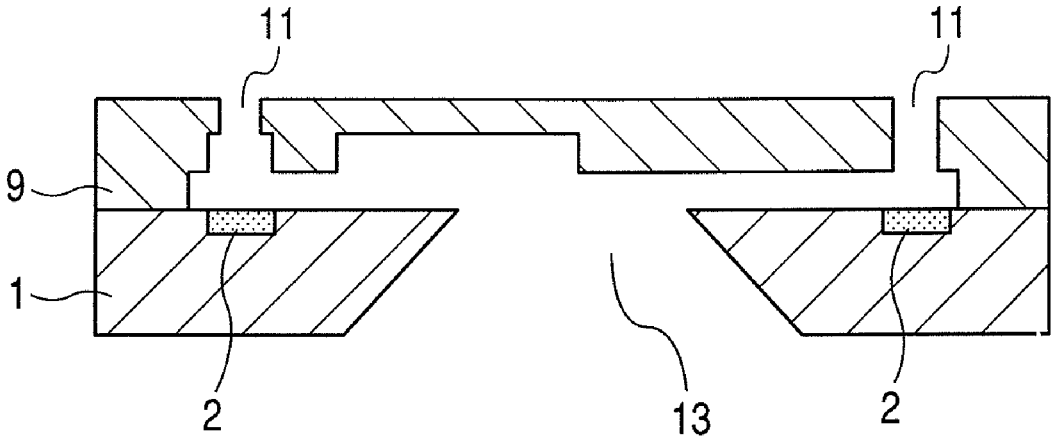
FIG. 4 is a schematic sectional view of an ink jet recording head including liquid flow paths having different heights.

The present invention is also suitable for manufacturing of an ink jet recording head including liquid flow paths having different heights obtained by changing a height of a mold material in a manufacturing stage. Examples of such an ink jet recording head include an ink jet recording head having a structure shown in FIG. 4. This structure of the ink jet recording head can be manufactured in the same manner as in the above embodiment except that mold materials 8 are formed in two stages and optimum exposure energy is applied to each of regions of an orifice plate having different thicknesses during exposure.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-059536, filed Mar. 6, 2006, which is hereby incorporated by reference herein in its entirety.

What is claimed is:

1. A manufacturing method of an ink jet recording head comprising:

providing a mold material of a positive resin having a shape of an ink flow path for communication with an ink discharge port for use in discharging ink;

providing a coating resin layer of a negative photosensitive resin on the mold material so as to coat a top surface of the mold material and a side surface of the mold material;

exposing a portion of a region of the coating resin layer positioned above the mold material and a region of the coating resin layer other than the region of the coating resin layer positioned above the mold material;

removing a non-exposure portion of the region of the coating resin layer positioned above the mold material to form the ink discharge port in the non-exposure portion of the region of the coating resin layer positioned above the mold material; and removing the mold material to form the ink flow path, wherein during the exposing of the coating resin layer, a total amount of exposure energy per unit area applied to the region other than the region of the coating resin layer positioned above the mold material is greater than that of exposure energy per unit area applied to the region of the coating resin layer positioned above the mold material.

2. A manufacturing method of the ink jet recording head according to claim 1, wherein the step of exposing the coating resin layer comprises exposing the region other than the region of the coating resin layer positioned above the mold material, and then exposing the region of the coating resin layer positioned above the mold material.

3. A manufacturing method of the ink jet recording head according to claim 1, wherein the step of exposing the coating resin layer comprises setting an exposure amount with which the region of the coating resin layer positioned above the mold material is irradiated to be less than that with which the region other than the region of the coating resin layer positioned above the mold material is irradiated by use of a mask having at least one portion of non-transmittance and two or more portions of different transmittance.

4. A manufacturing method of the ink jet recording head according to claim 1, wherein the ink discharge port has a polygonal shape.

5. A manufacturing method of the ink jet recording head according to claim 1, wherein the exposing step is performed completely after the step of forming the coating resin layer.

6. A manufacturing method of the ink jet recording head according to claim 1, wherein the step of exposing the coating resin layer comprises a first exposing step of exposing the region other than the region of the coating resin layer positioned above the mold material, and a second exposing step of then exposing the region of the coating resin layer positioned above the mold material as well as the region other than the region positioned above the mold material.

7. A manufacturing method of the ink jet recording head according to claim 6, wherein in the first exposing step a first amount of energy applied per unit area is selected from a first range and in the second exposing step a second amount of energy applied per unit area is selected from a second range, such that the sum of the first and second amounts of energy total a predetermined amount of energy applied per unit area.

8. A manufacturing method of an ink jet recording head according to claim 1, wherein the exposure energy applied to the region of the coating resin layer positioned above the mold material is within a range of 40 to 110 $mJ/cm^2$.

* * * * *